United States Patent [19]

Jolly et al.

[11] 4,241,461

[45] Dec. 30, 1980

[54] EXTENSIBLE LENGTH SLEEVE

[75] Inventors: William R. Jolly; James G. Kohn, both of Greenville, S.C.

[73] Assignee: Piedmont Industries, Inc., New York, N.Y.

[21] Appl. No.: 959,999

[22] Filed: Nov. 13, 1978

[51] Int. Cl.[3] ..... A41D 27/10

[52] U.S. Cl. ..... 2/269; 2/123

[58] Field of Search ..... 2/123, 124, 125, 126, 2/270, 269

[56] References Cited

U.S. PATENT DOCUMENTS

| | | | |
|---|---|---|---|
| 1,751,832 | 3/1930 | Menzin | 2/123 |
| 1,855,590 | 4/1932 | Stein | 2/269 |
| 2,155,706 | 4/1939 | Grigsby | 2/123 |
| 2,535,224 | 12/1950 | Nachem | 2/269 |
| 2,855,606 | 10/1958 | Berg | 2/123 |
| 3,111,681 | 11/1963 | Nelson et al. | 2/269 |
| 3,170,167 | 2/1965 | Isaccs | 2/269 |

FOREIGN PATENT DOCUMENTS

| | | | |
|---|---|---|---|
| 1500845 | 10/1967 | France | 2/269 |

*Primary Examiner*—Doris L. Troutman

*Attorney, Agent, or Firm*—Amster, Rothstein & Engelberg

[57] ABSTRACT

An extensible length sleeve which may be lengthened by the wearer utilizes a pair of seams to attach the sleeve cuff to the lower end of the sleeve. One of the seams is selectively removable to allow an underlying pleat in the sleeve fabric to be released, thus allowing the length of the sleeve to be extended. The attaching seams are hidden from view by sleeve fabric both before and after lengthening, so that the appearance of the sleeve is not altered by the lengthening.

2 Claims, 5 Drawing Figures

FIG. 1.
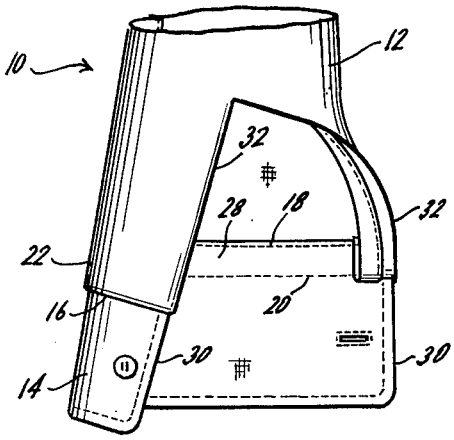
FIG. 3.
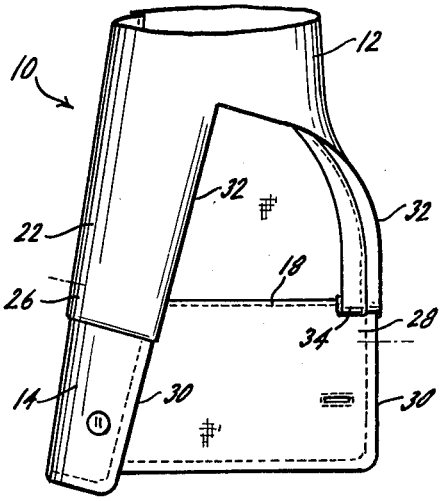
FIG. 2.
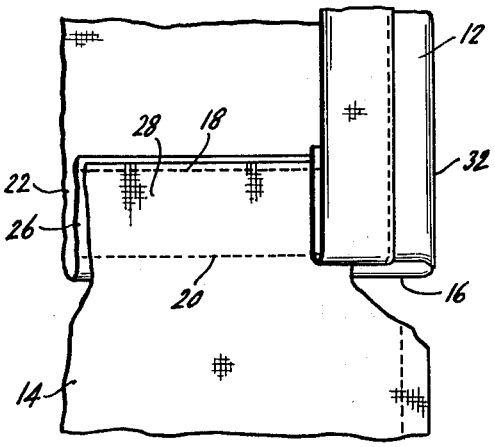
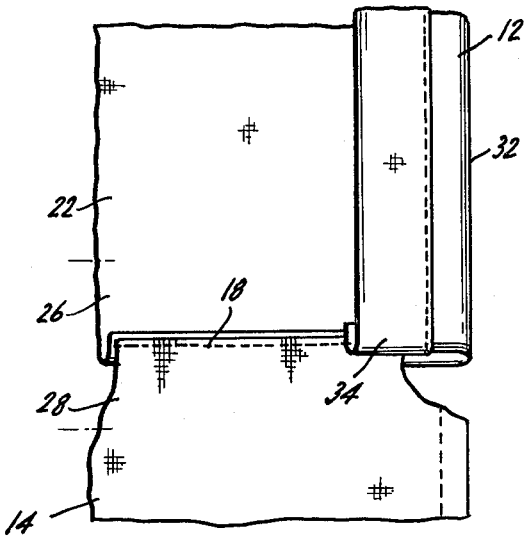
FIG. 4.
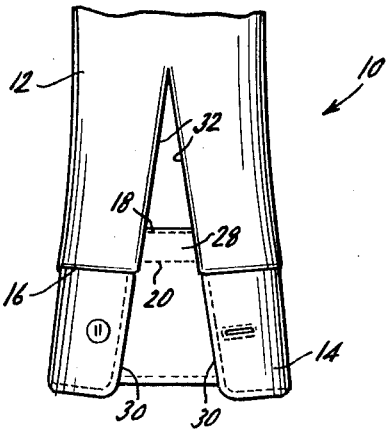
FIG. 5.

EXTENSIBLE LENGTH SLEEVE

This invention relates to the clothing arts and more specifically to a cuff-containing sleeve which may be selectively lengthened by the wearer. The appearance of the sleeve is the same both before and after lengthening.

A typical method for providing such an extensible sleeve consists of forming a fold or pleat in the sleeve fabric and anchoring it with removable fastenings, such as stitching. The prior art utilizing such stitching to secure the pleat has taken various forms. For example, in Kaplan, U.S. Pat. No. 2,158,456, dissolvable threads are used. In Weinkle, U.S. Pat. No. 3,843,972, two lines of exposed stitching are utilized. These methods of fastening, as well as the others disclosed in the prior art, require extra manufacturing steps or special equipment and material, thus increasing the cost of manufacture. They also present additional lines of stitching on the surface of the sleeve, thus creating a less-attractive garment.

It is an object of the present invention to provide an extensible sleeve construction that is economical to manufacture. It is another object of the present invention to provide an extensible sleeve in which the fastening seams are hidden from view, both before and after sleeve extension.

It is a further object of the present invention to provide an extensible sleeve construction which will maintain the same appearance both before and after lengthening. It is still a further object of the invention to provide an extensible length sleeve which will permit a manufacturer to make a shirt which will properly fit two different sleeve-length buyers, and which may be adjusted by the buyer himself without the need of special equipment or tools.

In accordance with the objects of the present invention, an extensible sleeve is provided which consists of a sleeve, a cuff attached to the sleeve, and a pleat formed in the sleeve material. The pleat lies upon the outside surface of the cuff and is secured to the cuff by means of a seam of removable stitching. The stitching line is located at the edge of the pleat and secures the lower layer of the pleat, which is the layer of fabric lying directly upon the cuff, to the cuff. By locating the sleeve fabric on the outside surface of the cuff material, both the removable line of stitching, which provides the adjustable feature, and the permanent line of stitching which secures the sleeve end to the cuff are concealed by fabric.

To increase the length of the sleeve, the line of removable stitching is removed from the fabric and the pleat is unfolded. This adds both length to the sleeve and visible length to the cuff, as the additional cuff length was previously hidden by the sleeve pleat.

The above advantages and objects of the invention will be more fully appreciated with reference to the following detailed description of a preferred, illustrative embodiment when taken in conjunction with the following drawings, wherein:

FIG. 1 is a perspective view of the extensible sleeve in the unlengthened configuration;

FIG. 2 is a perspective view of a portion of the sleeve of FIG. 1 showing the detail of the sleeve-cuff attachment;

FIG. 3 is a perspective view of the extensible sleeve in the lengthened configuration;

FIG. 4 is a perspective view of a portion of the sleeve of FIG. 3 showing the detail of sleeve-cuff attachment after lengthening; and FIG. 5 is a plan view of a sleeve showing its general appearance upon wearing.

As seen in FIGS. 1 and 2, extensible sleeve 10 consists of sleeve 12 with conventional sleeve slit edges 32, and cuff 14. The lower end of sleeve 12 contains pleat fold line 16, which allows pleat section 26 to underlie section 22 of sleeve 12 and lie against the outside surface of cuff 14. The circumferential width of the lower end of sleeve 12 is greater than that of cuff 14, and the additional fabric, including pleat section 26, is wrapped around the edges 30 of cuff 14 to form the lower end of sleeve slit edges 32. Overlock stitch seam 18 attaches the end of sleeve 12, which is also the end of underlying pleat section 26, to cuff 14. The free end of pleat section 26 is secured to cuff 14 by means of chain stitch seam 20 located along pleat fold line 16 and which is selectively removable. Both overlock stitch seam 18 and chain stitch seam 20 are hidden from view by pleat-overlying sleeve section 22, since both seams pass through cuff 14 and underlying pleat section 26 only.

In a typical manufacturing procedure, overlock stitch seam 18 is first run to join cuff 14 and sleeve 12. This can be easily accomplished with the sleeve and cuff lying in an inside-out position, as is familiar to one skilled in the art. The pleat is then made in cuff 12 and chain stitch seam 20 is run. This seam can also be easily run with the sleeve in an inside-out position with the sleeve material lying over the cuff, as is familiar to the art. Both sleeve and cuff can be made of any typical shirt material, such as cotton or cotton/polyester blends.

FIGS. 3 and 4 illustrate the sleeve upon lengthening. Chain stitch seam 20 has been removed. This frees pleat section 26 from cuff 14 and allows upper cuff section 28, which was formerly hidden under pleat section 26, as well as inner pleat section 26, to be exposed, thus adding extra length to the sleeve. The actual length added is twice the pleat length, which allows a relatively small pleat to provide an acceptable length increase. Such a pleat length is normally in the range of ½ inch to provide a one inch overall length increase. Overlock stitch seam 20 is still hidden from view by overlying section 34 of now lengthened sleeve 12.

FIG. 5 shows the extensible sleeve as it would appear to an observer prior to lengthening. Neither seam 18 nor seam 20 can be observed on the outside of the sleeve, and the wraparound of the sleeve material around the sides of the cuff produces a neatly finished appearance.

While the foregoing description has been applied to a specific embodiment, it is to be realized that modifications and adaptations may be made within the scope of the invention as claimed.

What is claimed is:

1. An extensible length sleeve comprising a sleeve having a lower section having sleeve slit edges and terminating in a pleat having a transverse pleat fold line and an underlying pleat section lying against the inside surface of said sleeve, and a cuff having an upper end and of a width less than the width of said sleeve, the upper end of said cuff connected to said underlying pleat section, the additional width of said sleeve being disposed about the sides of said cuff to provide a finished edge for said sleeve slit edges, said cuff and said underlying pleat section connected by a first line of stitching adjacent the end of said pleat and connecting said underlying pleat section and said upper end of said cuff and a second line of stitching adjacent said pleat fold line connecting said underlying pleat section and said upper end of said cuff, said first and second stitch lines being hidden from view by the portion of said sleeve overlying said underlying pleat section, said second line of stitching being selectively removable to allow said pleat to be opened to provide additional length to said extensible length sleeve.

2. The extensible length sleeve of claim 2 wherein said first line of stitching is an overlock seam stitch and said second line of stitching is a chain stitch.

* * * * *